US006272897B1

(12) United States Patent
Ciranna

(10) Patent No.: US 6,272,897 B1
(45) Date of Patent: Aug. 14, 2001

(54) METHOD OF FORMING HONEYCOMB PANELS INTO COMPOUND CURVED SHAPES

(76) Inventor: Anthony D. Ciranna, 2120 Montera, Hacienda Heights, CA (US) 91745

( * ) Notice: Subject to any disclaimer, the term of this patent is extended or adjusted under 35 U.S.C. 154(b) by 0 days.

(21) Appl. No.: 09/512,964

(22) Filed: Feb. 25, 2000

(51) Int. Cl.[7] ..... B21D 25/02
(52) U.S. Cl. ..... 72/296; 72/302; 72/379.2
(58) Field of Search ..... 72/297, 296, 302, 72/303, 385, 379.6

(56) References Cited

U.S. PATENT DOCUMENTS 2,444,719 * 7/1948 Bath ..... 72/372
2,920,676 * 1/1960 Turnblade ..... 72/297
3,307,387 * 3/1967 Lacey ..... 72/379.6
3,748,889 * 7/1973 Miller ..... 72/385
4,450,706 * 5/1984 Engelmohr ..... 72/385
4,747,292 * 5/1988 Chorneau ..... 72/297
5,115,661 * 5/1992 McGowan ..... 72/297
5,237,848 * 8/1993 Campbell ..... 72/296

* cited by examiner

*Primary Examiner*—Daniel C. Crane
(74) *Attorney, Agent, or Firm*—Roy A. Ekstrand

(57) ABSTRACT

A generally planar metal honeycomb panel is formed into a complex compound curved shape by initially forming a primary first curvature in the panel using a conventional stretch wrap process. Following the primary stretch wrap process, a second stage form block having a curved portion conforming to the primary curvature and reverse curved shoulder portions is positioned against the primary curved portion of the honeycomb panel. Thereafter, a reverse wrap process is applied to the honeycomb panel to form an undulating wave form panel. The undulating wave form panel is then subjected to a secondary stretch wrap process upon a secondary stretch form block having the undulating curvature of the undulating wave form plate in one direction and a further curvature in the transverse direction thereto. In an alternate method, primary first curves and secondary stretch wrap are used to form panels which are joined by welding or other attachment to form more severely reverse-curved panels.

17 Claims, 7 Drawing Sheets

METHOD OF FORMING HONEYCOMB PANELS INTO COMPOUND CURVED SHAPES

FIELD OF THE INVENTION

This invention relates generally to methods of metal forming and particularly to methods of forming difficult to form metal panels such as generally planar honeycomb metal panels which are comprised of a spaced apart pair of metal sheets commonly joined to an internal corrugated core into complex compound curved shapes.

BACKGROUND OF THE INVENTION

In many industries such as aviation fabrication, the need arises to provide materials and structures which are light-weight and strong. While many light-weight and strong structures may be provided through the use of exotic metals and alloys, a great number of structures are required which can not support the expense generally encountered through the use of exotic, light-weight, high-strength metals. One of the most useful fabrication materials for providing structures which maintain high-strength while simultaneously being light in weight is found in so-called "honeycomb" metal panels. Such panels are usually formed of a pair of generally planar metal sheets often referred to as face sheets together with a matrix or core material. In most honeycomb panels, the matrix or core is formed of a generally corrugated structure fabricated of long thin metal strips which are multiply curved or faceted and periodically joined together to form a high-strength matrix or core. One of the most common core structures utilizes elongated thin metal strips which form a core structure generally resembling a section of a common beehive. The face sheets are joined to the edges of the core strips by attachments such as welding or adhesive attachment. Other forms of attachments such as braising, crimping or other means may be used with the overall objective being secure attachment between the matrix or core edges and the face sheets to provide a strong, light-weight and substantially rigid panel.

FIG. 1 sets forth a partially sectioned perspective view of a typical honeycomb constructed in accordance with conventional fabrication techniques and generally referenced by numeral 10. Panel 10 is shown to include a pair of generally planar metal sheets 11 and 12 formed of a material such as steel or other suitable metal. Panel 10 further includes a core 13 typically formed of a plurality of thin metal strips such as steel or the like multiply faceted and joined together to form a honeycomb-like structure. While not seen in FIG. 1, it will be understood in accordance with conventional fabrication techniques metal sheets 11 and 12 are commonly joined to their respective edges of core 13 by conventional fabrication such as welding, braising, adhesives or other attachment. For purposes of illustration, panel 10 is shown in a generally rectangular shape having opposed edges 14 and 15. It will be understood however that honeycomb panels of different shapes are often used in particular fabrications.

While honeycomb panels of the type shown in FIG. 1 provide an extremely cost effective and light-weight, high-strength fabrication material which is in many respects desirable for manufacturing processes, a substantial limitation has thus far arisen in the difficulty found in shaping such honeycomb panels to suit manufacturing needs. In many instances fabrications are provided in which the honeycomb panels are cut and welded together in sections to provide shapes which are generally angular or faceted in character. Unfortunately a substantial number of manufacturing needs such as those in aviation fabrication require that materials be formable into curved elements rather than faceted. The honeycomb core and face sheet combination of honeycomb panels does not allow the panels to be formed using conventional rolling or stamping processes due to the tendency of such processes to crush or deform the core material or overly stress the attachment of the core edges to the face sheets.

One of the most successful processes thus far developed for forming honeycomb panels into curved shapes for use in industries such as aviation fabrication is generally known as the "stretch wrap" or "stretch forming" process.

While stretch wrap or stretch forming processes have been developed in some variety, the basic stretch forming process utilizes an apparatus often referred to as "stretch wrap machine" in which the to-be-formed panel is positioned within a work station having a stationary support upon which a form block is secured. The form block defines a curved surface corresponding to the desired curvature which is to be imparted to the honeycomb panel. The remainder of the work station often referred to as a main frame supports a plurality of power driven articulated devices often referred to as articulated arms. Each supports a plurality of gripping jaws or other apparatus utilized in grasping the opposed edges of the honeycomb panel.

In some stretch wrap machines the jaw structures of the articulated arms may grip the panel edges directly. However, more often pluralities of elongated metal pull tabs are welded to each side of the honeycomb panel along opposed edges thereof. For the most part such pull tabs are usually arranged in pairs on each of the face sheets along the panel edges. The jaw structures of the articulated arms then grip the pluralities of pull tabs rather than the panel edges themselves. Once the panel is secured in the jaw structures within the stretch wrap machine, forces are applied to the articulated arms to draw the panel edges outwardly and thereby place the honeycomb panel in a predetermined tension. This tension is generally transverse to the major axes of the curved face of the form block. Once sufficient tension has been imposed upon the honeycomb panel, the articulated arms are then driven toward and beyond the form block to literally wrap it partially about the curved face of the form block. The wrapping process is carried forward while maintaining the panel in tension. It has been found that the maintenance of substantial tension upon the honeycomb panel during the wrapping process allows the panel to be formed into a curved shape without damaging the panel. The limitation on this process being care to ensure that the compressive strength of the core is not met or exceeded.

Once the wrapping process is complete, the tension applied to the panel is released and the panel curvature remains. Usually as the tension is relaxed a small amount of recovery or "spring back" occurs in the panel. However, for the most part, the panel retains its curvature.

For purposes of illustration, a perspective view of a simplified stretch wrap apparatus and honeycomb panel in FIG. 2. Thus, FIG. 2 shows a conventional stretch wrap machine generally referenced by numeral 20 having a stationary spine 16 supporting a form block 17. Form block 17 defines a curved surface 18 which in the illustration of FIG. 2 is a cylindrical segment. Stretch wrap machine 20 further includes pluralities of gripping jaws 23 and 24 supported by a pair of articulated arms 25 and 26 respectively. Arms 25 and 26 as well as pluralities of jaws 23 and 24 are fabricated in accordance with conventional fabrication techniques which are known in the art. While not seen in FIG. 2, it will be understood that conventional apparatus are utilized in stretch wrap machine 20 for supporting spine 16 and for articulating arms 25 and 26. Further, gripping jaw pluralities 23 and 24 are conventional and include conventional means for gripping (not shown). In accordance with conventional stretch wrap machine forming processes a honeycomb panel 10 having edges 14 and 15 is positioned within stretch wrap machine 20 and is supported by a pair of pull tabs 22 along edge 14 and a pair of pull tabs 21 along edge 15. As described above, pull tab pairs 21 and 22 are typically arranged on each side of one edge of panel 10 and are typically joined to the panel edge portions by welding attachment or the like. As is also mentioned above, jaw pluralities 23 and 24 grip the outwardly extending ends of pull tab pairs 21 and 22.

In operation, and as is described above, stretch wrap machine 20 utilizing power drive apparatus of conventional fabrication (not shown) draws arms 25 and 26 outwardly from edges 14 and 15 in the directions indicated by arrows 27 and 28. As a result, panel 10 is placed in tension in a force direction which is generally transverse to the major axes or axes of elongation of curved face 18 of form block 17. Once the predetermined tension has been applied to panel 10, the operating means driving arms 25 and 26 (not shown) force panel 10 rearwardly against curved surface 18 of form block 17 wrapping panel 10 against curved surface 18 in the directions indicated by arrows 29 and 30. The combination of tension applied to panel 10 and rearward force of arms 25 and 26 wraps panel 10 about curved surface 18 and beyond imposing a curvature upon panel 10 which corresponds generally to the curvature of curved surface 18.

Once the desired curvature has been imposed upon panel 10, the forces applied to panel 10 are released and the now curved panel corresponding to the dash-line representation in FIG. 2 is removed from the stretch wrap machine. Thereafter, excess material is cut from the curved panel and a completed curved element is provided.

In a typical stretch wrap fabrication process, a closed form such as a cylindrical form or the like is fabricated using a plurality of curved segments. The plurality of segments are usually joined to form a closed object using a welding process or the like.

FIG. 3 sets forth an illustrative closed form fabricated in accordance with conventional fabrication techniques illustrated in FIGS. 1 and 2 and described above. In the illustration of FIG. 3, a cylindrical form 30 is fabricated of a plurality of curved segments 19, 29 and 31 respectively joined along welded seams 32, 33 and 34 to form a cylinder. It will be recognized that segment 19 is formed as illustrated in FIG. 2 from panel 10 once the excess material is removed from the edges thereof. It will be further recognized that segments 29 and 31 are substantially identical to segment 19 and thus will be understood to have been formed in the manner illustrated in FIG. 2. The result in the fabrication shown in FIG. 3 provides a light-weight, high-strength cylindrically formed structure.

Despite the advantages of the conventional stretch wrap forming process described above in fabricating curved structures from honeycomb panels, a significant limitation arises in that the conventional stretch wrap forming process above is unable to fabricate complexly compound curved shapes. Thus, while shapes such as the cylindrical form shown in FIG. 3 are relatively easy to fabricate, shapes having reverse direction curves such as segments defining S-Shaped curvatures have not heretofore been formable using conventional stretch wrap fabrication. Furthermore, complex curves having differing axes of curvature are not formable using presently available stretch wrap methods and apparatus. By way of illustration, a frequently occurring type of complexly compound curved shape is found in objects often described as "coke bottle" shapes. This shapes acquires its name from its resemblance to certain commercial beverage bottles of the type manufactured by the Coca cola bottling company. However, the persuasiveness of such shape characteristics has caused the so-called coke bottle shape to acquire its own meaning within aviation fabrication industries.

Because such shapes are often utilized in industries such as aviation fabrication, and because honeycomb panels represent an otherwise attractive and light-weight advantageous fabricating material, there arises a continuing need in the art for method and process which facilitates the forming of honeycomb metal panels into compound complexly curved shapes.

SUMMARY OF THE INVENTION

Accordingly, it is a general object of the present invention to provide an improved method of forming curved shapes in difficult-to-form metal panels such as honeycomb metal panels. It is a more particular object of the present invention to provide an improved method of forming difficult-to-form metal panels such as honeycomb panels into compound curved shapes. It is a still more particular object of the present invention to provide an improved method of forming metal difficult-to-form panels such as honeycomb panels into complex compound curved shapes.

In accordance with the present invention there is provided a method of forming a generally planar honeycomb panel into a compound curved shape comprising the steps of: providing a generally planar panel; forming a primary curvature in the panel to form the panel into an undulating wave form panel; and forming a transverse curvature in the undulating wave form panel by producing a curvature in the undulating wave form panel transversely oriented with respect to the primary curvature. It will be noted that while the present invention is described below using honeycomb metal panels, the invention is not limited to honeycomb panel forming but is equally applicable to other metal panels.

In a more detailed sense, the present invention provides a method of forming a generally planar honeycomb panel into a compound curved shape comprising the steps of: providing stretch wrap apparatus having form block supports and articulated arms; providing a primary form block having a primary curve face and supporting the primary form block upon the stretch wrap apparatus; providing a generally planar honeycomb panel; positioning the honeycomb panel against the primary form block; coupling the articulated arms to opposed sides of the honeycomb panel; applying tension to the honeycomb panel; wrapping the honeycomb panel against the primary form block; providing a second stage form block defining a conforming curvature conforming to the primary curve face and at least one reverse curvature; positioning the second stage form block against the honeycomb panel; while maintaining the honeycomb panel in tension, reverse wrapping the honeycomb panel against the at least one reverse curvature to form an undulating wave form panel; providing a secondary stretch form block having an undulating curved surface conforming to the undulating wave form panel and transverse curved surface; positioning the undulating wave form panel against the secondary stretch form block; coupling the articulated arms to opposed sides of the undulating wave form panel; applying tension to the undulating wave form panel; and while maintaining the tension, wrapping the undulating wave form panel against the secondary stretch form block to impart a transverse curvature to the undulating wave form panel corresponding to the transverse curved surface.

In the event the panel being formed does not define a reversely curved portion, the primary curved panel is moved directly to wrap about the secondary stretch form block.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

By way of overview, the present invention of forming honeycomb panels into compound complexly curved shapes utilizes a conventional stretch wrap process to form a primary curve in a honeycomb metal panel. Thereafter, a secondary back wrap or reverse wrap forming process is applied to the curved honeycomb panel to form the honeycomb panel into a shape referred to herein as an "undulating" panel. As used herein, the term undulating panel refers to the shape imparted to a planar honeycomb panel in which a simple or complex undulating wave form is formed generally of one or more curvatures having axes of curvature which are generally parallel. Once the undulating wave form plate has been formed in one direction, the panel is reoriented by approximately ninety degrees to apply curvature which is transverse to the curvatures of the undulating plate and thereby form complex compound curved shapes. The preferred method of providing the forming processes utilizes various combinations of form blocks and stretch wrapping processes.

Figure 1:
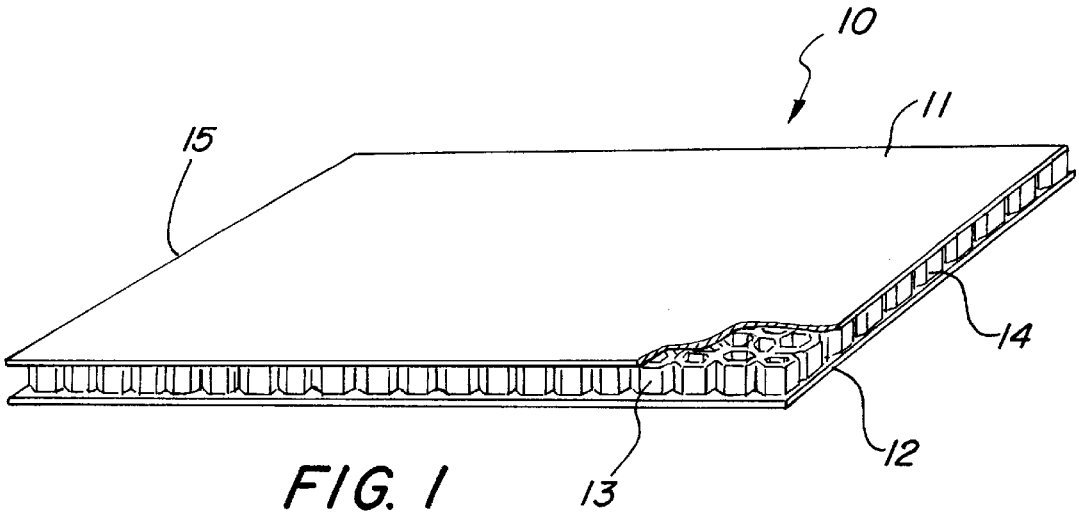
FIG. 1 PRIOR ART
FIG. 1 sets forth a partially sectioned perspective view of a conventional honeycomb metal panel fabricated in accordance with the prior art.
Figure 2:
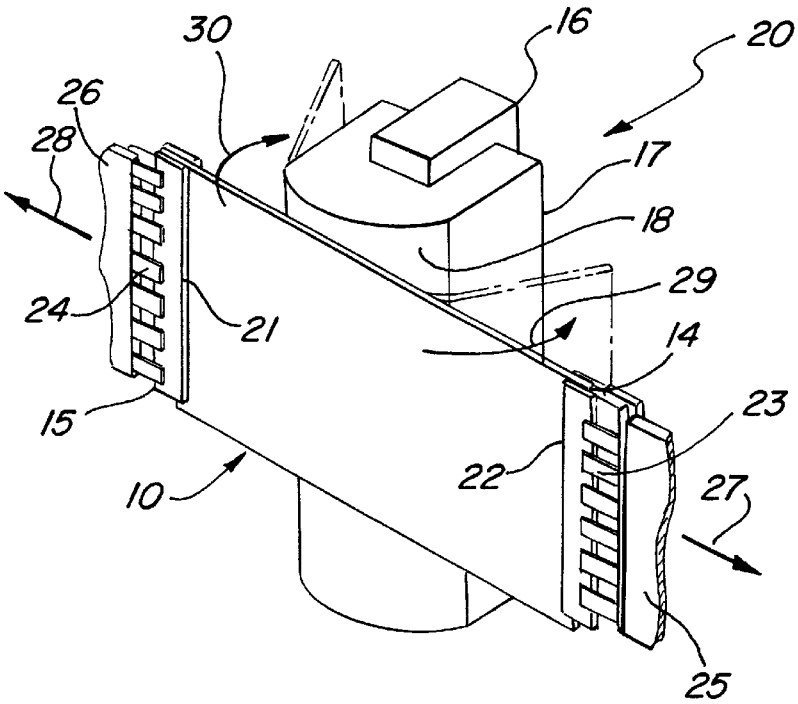
FIG. 2 PRIOR ART
FIG. 2 sets forth a perspective view of a conventional prior art stretch wrap machine processing a conventional honeycomb metal panel.
Figure 3:
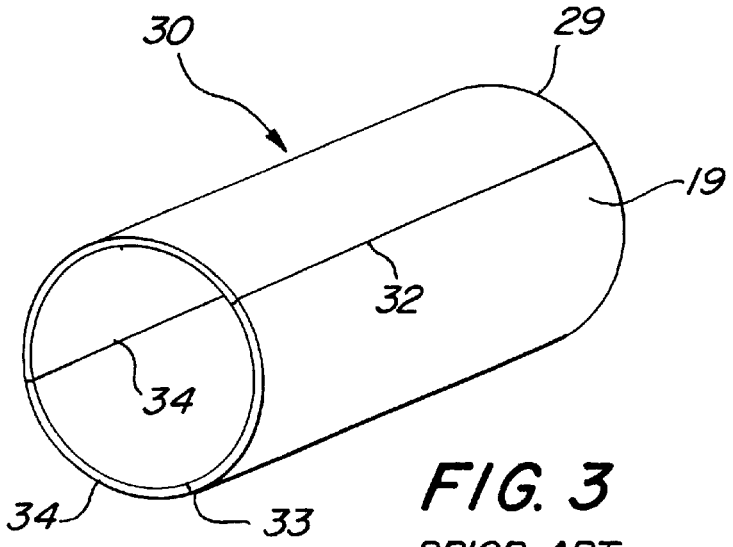
FIG. 3 PRIOR ART
FIG. 3 sets forth a perspective view of a cylindrical form fabricated in accordance with conventional prior art fabrication techniques.
Figure 4:
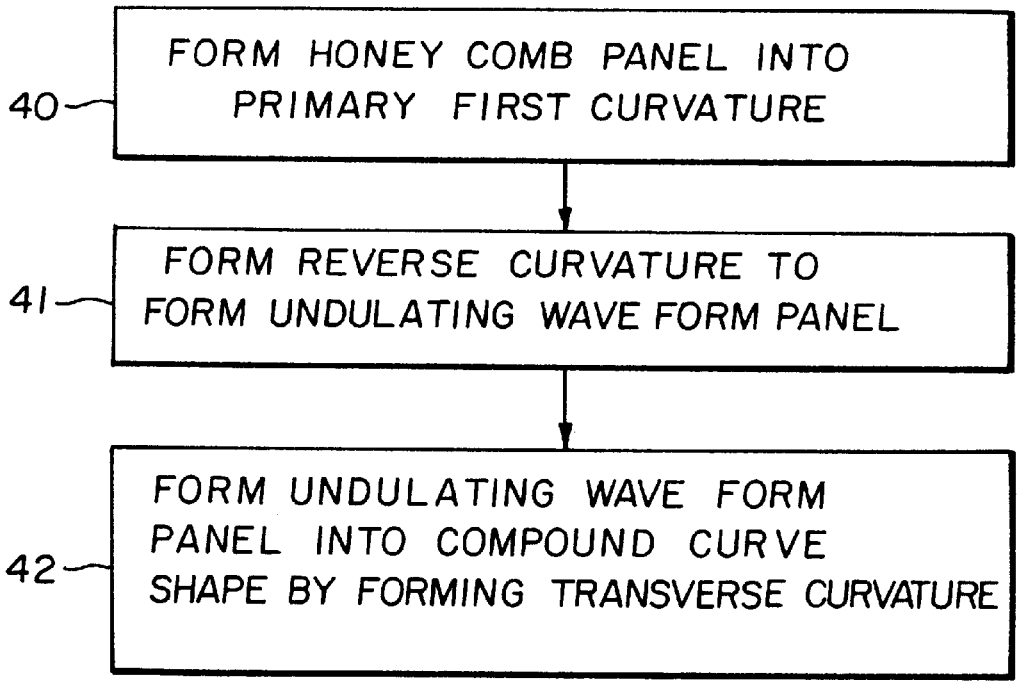
FIG. 4 sets forth a simplified flow diagram of the present invention method of forming honeycomb panels into compound curved shapes.

FIG. 4 sets forth a generalized block diagram of the present invention method of forming metal honeycomb panels into compound curved shapes. At an initial step 40 a generally planar metal honeycomb panel is formed initially into a primary first curvature within the interior portion of the honeycomb panel.

Thereafter, at step 41 at least one reverse curved curvature is imparted to the honeycomb panel in one or more of the remaining portions of the honeycomb panel to form an undulating wave form plate. The axes of curvature of the primary first curvature and the at least one reverse curvatures are generally parallel to produce undulating curvatures in the undulating wave form plate which are wave-like in character. For example, a typical undulating wave form plate when viewed in edge view defines a compound curve such as an "S-Shaped" curve.

Thereafter, at step 42 the undulating plate is formed into a compound complex curved shape by curving the undulating plate in a curvature which is transverse to the undulation curvatures. The transverse curvature produces an axes of curvature which is generally in quadrature relationship to the axes of the undulation curvatures.

The resulting shape provides compound complex curvature of the honeycomb plate and facilitates the fabrication of a variety of curved shapes such as those often utilized in industries such as the aviation fabrication industry. In the preferred implementation of the present invention method of forming honeycomb panels into compound complex curved shapes, the forming process of step 40 is carried forward in a generally conventional stretch wrap process while the forming process set forth in step 41 utilizes a novel second stage forming block in combination with the conventional primary forming block to perform a backward or reverse wrap of either or both edge portions of the honeycomb plate to produce the undulating wave form plate. Further, in the utilization of a stretch wrapping process to carry forward the present invention method, step 42 is achieved by reorienting the undulating plate approximately ninety degrees from its orientation in steps 40 and 41 and thereafter transversely stretch wrapping the undulating wave form plate against a secondary form block which defines the undulating curvature corresponding to the undulating plate and which further defines a secondary curvature transverse to the undulation curvature about which a secondary stretch wrapping process is applied.

As a result, a portion of the present invention method may be carried forward using conventional stretch wrap machines and form blocks shaped and utilized as described below in greater detail while to remaining portion of the present invention method requires a variable displacement tension bar shown in FIG. 10.

Figure 5:
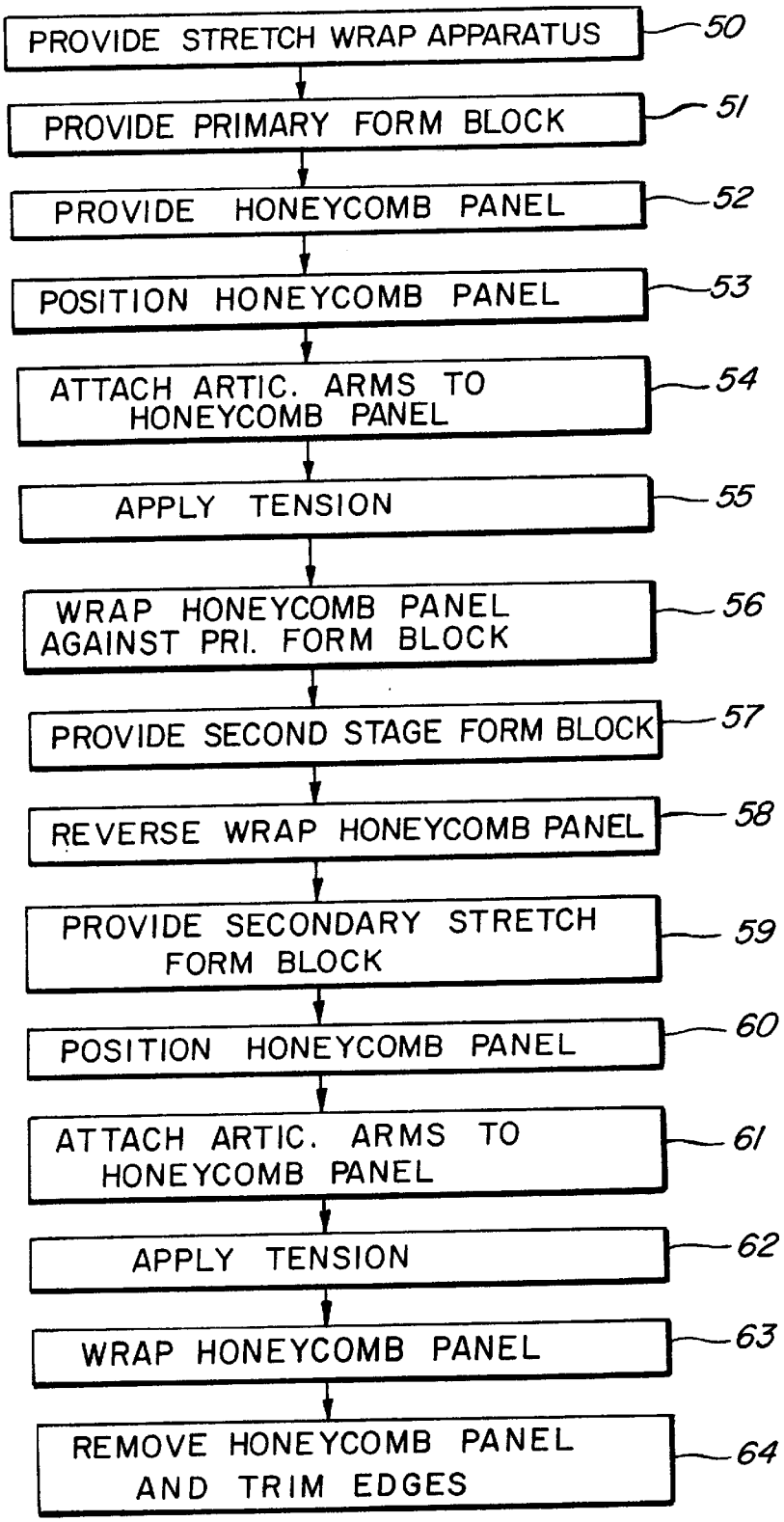
FIG. 5 sets forth a detailed flow diagram of the present invention method of forming honeycomb panels into compound curved shapes.

FIG. 5 sets forth a more detailed block diagram of the present invention method is initiated at a step 50 in which a stretch wrap apparatus having means for supporting a plurality of form blocks and a pair of articulated power driven arms is provided. Thereafter, the present invention method moves to a step 51 in which a primary form block having a primary curved face is provided and supported within the stretch wrap apparatus. Thereafter, at a step 52 a generally planar metal honeycomb panel is provided. At step 53 the honeycomb panel is positioned within the work station of the stretch wrap apparatus in contact with and against the curved face of the primary form block.

At step 54, the conventional articulated arms of the stretch wrap apparatus are attached to opposed edges of the honeycomb panel. The attachment of the power driven articulated arms of the stretch wrap apparatus to the opposed edges of the honeycomb panel is arranged such that the major axes of the primary form block is generally parallel to the opposed edges of the honeycomb panel. At step 55, the articulated arms of the stretch wrap apparatus are power driven outwardly by conventional operative means to place the honeycomb panel in tension. The direction of tension is transverse to the elongation axes of the primary form block.

Figure 6:
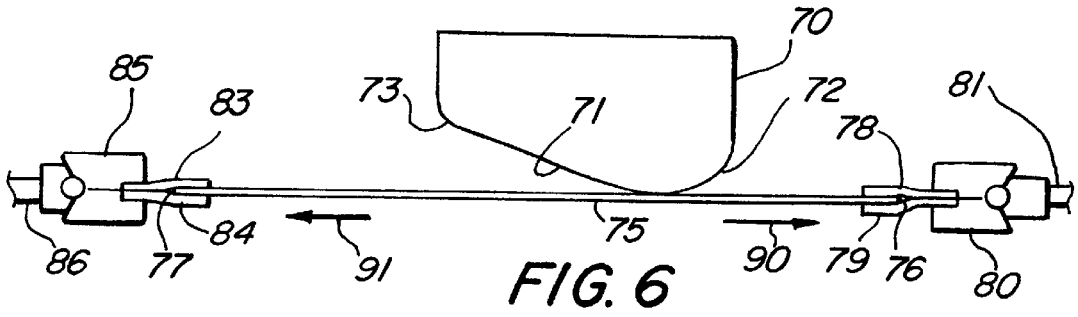
FIG. 6 sets forth a simplified plan view of the initial step of forming a honeycomb panel into a compound curved shape.
Figure 7:
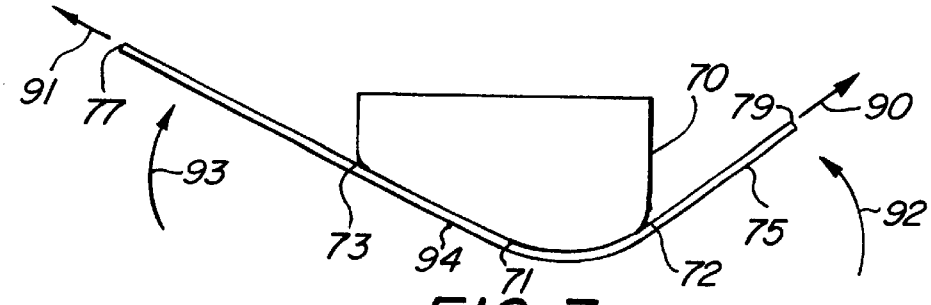
FIG. 7 sets forth a plan view of the first stage wrap of the present invention method of forming a honeycomb panel into a compound shape.
Figure 8:
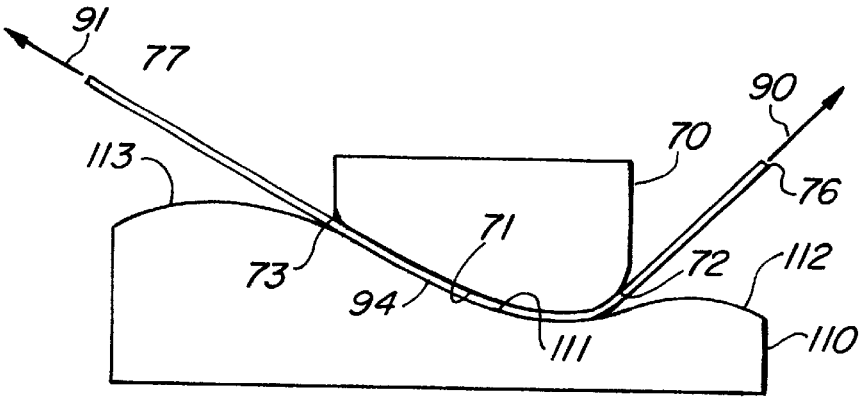
FIG. 8 sets forth a plan view of an intermediate step of the present invention method of forming a honeycomb panel into a compound shape in which the second stage forming block is positioned.
Figure 9:
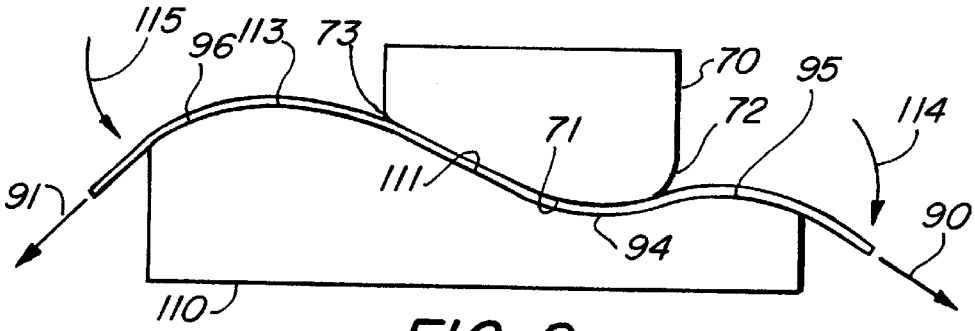
FIG. 9 sets forth a top plan view of the present invention method of forming a honeycomb panel into a compound curved shape in which the reverse wrap is shown.

Steps 50 through 55 of the present invention method are illustrated in FIG. 6 and described below in greater detail. The method then proceeds to a step 56 in which the honeycomb panel is maintained in tension and forced against the curved face of the form block wrapping the honeycomb panel upon the primary form block and curving the honeycomb panel in accordance with the curvature of the primary curve face of the primary form block. Step 56 is illustrated in FIG. 7 and described below in greater detail. At step 57, a second stage form block is provided which defines a curved surface having a portion conforming generally to the curvature of the primary curve face of the primary form block. The surface of the second stage form block further defines one or more reverse curvature portions on one or more sides of the conforming surface to facilitate a reverse wrap as described below. Thereafter, at step 58 the second stage form block is positioned against the honeycomb panel such that the conforming surface of the second stage form block which fits the curvature imposed by the primary form block upon the honeycomb panel is aligned with the curved honeycomb panel portion. This alignment is shown in FIG. 8 and described below in greater detail. Also within step 58, the tension applied to the honeycomb panel is maintained as the second stage form block is placed against the honeycomb panel under controlled pressure. Thereafter, while still maintaining the tension upon the honeycomb panel, the articulated arms of the stretch wrap machine are actuated in a reverse direction to impart a reverse wrap upon the honeycomb panel against the reverse curvature surfaces of the second stage form block. This imparts a complex curve to a portion of the honeycomb panel and forms an undulating wave form panel such as panel 100 shown in FIG. 10. The reverse wrap of the honeycomb panel which forms the undulating wave form panel is shown in FIG. 9 and described below in greater detail.

In the event the panel being formed does not define a reverse curvature, steps 57 and 58 are omitted. With steps 57 and 58 omitted, the panel having the primary curve formed at step 56 is moved to step 59 to impart a secondary curvature as described below.

At this point, the primary stage of the present invention method of forming honeycomb panels into compound complex curved shapes has been completed with the formation of the undulating panel. Following step 58, the panel is released from the articulated arms of the stretch wrap machine in order to proceed with the secondary stage panel forming.

The secondary stage of the present invention forming process begins at step 59 in which a secondary stage form block is provided. The secondary stage form block defines a compound curved surface having a curvature in one direction which conforms to the compound curve of the undulating wave form panel. The compound curvature of the secondary stage form block further defines a curvature in a second direction generally transverse to the compound curvature corresponding to the undulating wave form panel.

Figure 10:
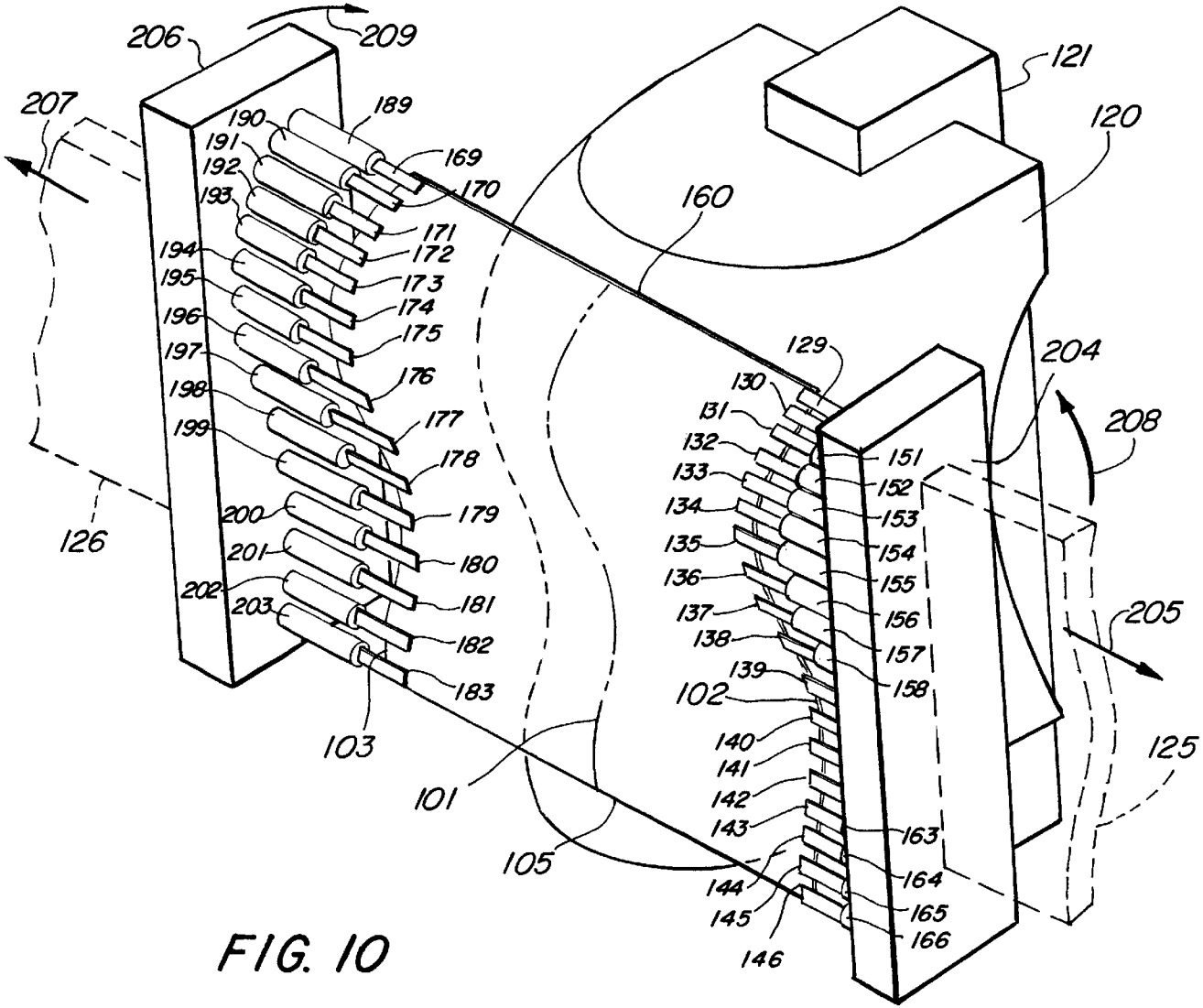
FIG. 10 sets forth a perspective view of the curved panel shown in FIG. 9 positioned for the second stage of the present invention method of forming a honeycomb panel into a compound curved shape.

At step 60, the undulating wave form panel is positioned against the secondary stage form block such that the undulating wave form panel touches the conforming curved surface of the secondary stage form block along a contact line as shown in FIG. 10. At step 61, the articulated arms of the stretch wrap apparatus are attached to the opposed edges of the undulating wave form panel on each side of the contact line. Steps 59, 60 and 61 are illustrated in FIG. 10.

Figure 11A:
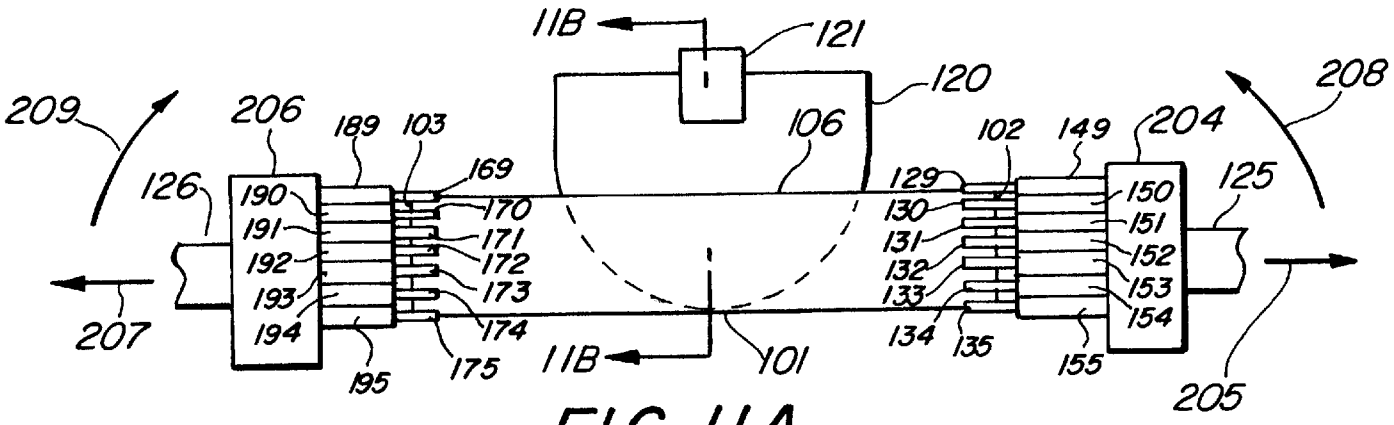
FIG. 11*a* sets forth a top plan view of the panel and form block shown in FIG. 10 prior to the initiation of the second stage of the present invention panel forming process.
Figure 11B:
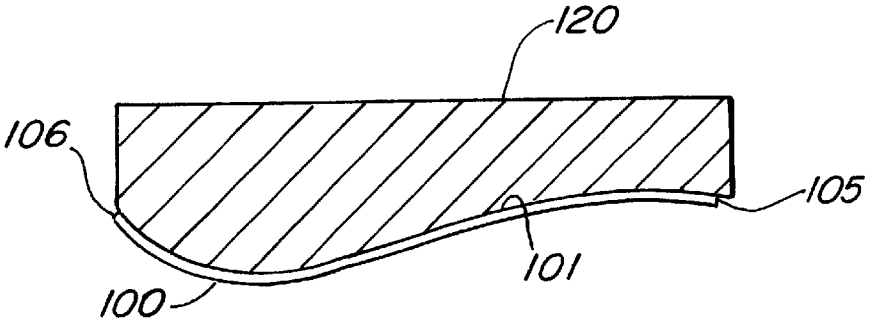
FIG. 11*b* shows a section view of the panel and forming block of 11*a* taken along section lines 11*b*—11*b* in FIG. 11*a;*

At step 62, the stretch wrap apparatus is energized to force the articulated arms outwardly and impose a tension in the undulating wave form panel which is directed outwardly from the contact line. Step 62 is illustrated in FIGS. 11*a* and 11*b*.

Figure 12:
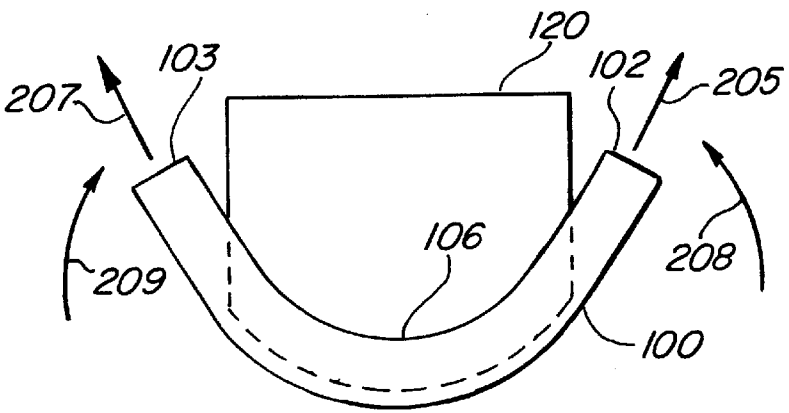
FIG. 12 sets forth a top plan view of the panel and forming block shown in FIG. 11*a* following the second stage forming operation in accordance with the present invention.

At step 63, the articulated arms of the stretch wrap machine are moved against the secondary stage form block to force the undulating wave form panel while still in tension against the secondary stage form block so-as-to wrap the undulating wave form panel against the transverse curvature of the secondary stage form block. This wrapping of the undulating wave form panel upon the transverse curvature of the secondary stage form block under tension transforms the undulating wave form panel to a compound complex curved shape. Step 63 is illustrated in FIG. 12 and described below in greater detail.

Figure 13:
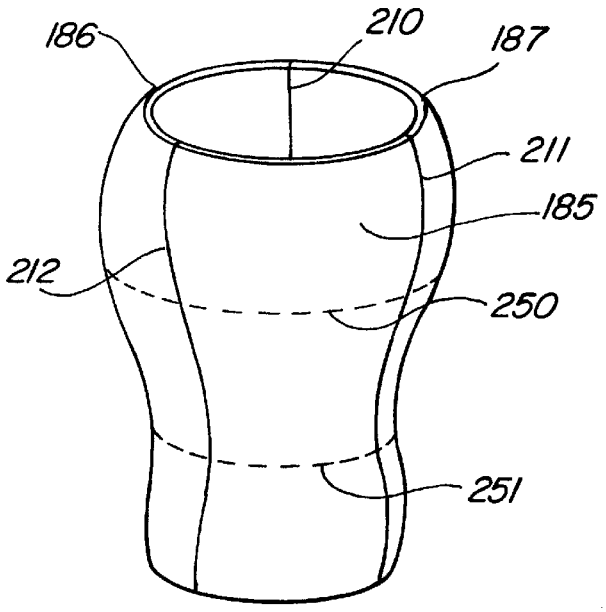
FIG. 13 sets forth a perspective view of a closed complexly compound curved form fabricated in accordance with the present invention.

Finally at step 64, the tension imposed upon the honeycomb panel is relieved and the now compound complex curved panel is removed from the stretch wrap apparatus. As a final step, excess edge material including the pull tabs is cut from the shaped panel producing a completed panel of the desired shape. Step 64 is illustrated in FIG. 13 and described below in greater detail.

FIG. 6 sets forth a top plan view of a honeycomb panel 75 positioned within a conventional stretch wrap apparatus having a primary form block 70. Primary form block 70 defines a primary curve face 71 and a pair of shoulder portions 72 and 73. While not shown in FIG. 6, it will be understood that in accordance with conventional fabrication techniques primary form block 70 is supported in a stationary support within a conventional stretch wrap machine. In further accordance with conventional fabrication techniques, a plurality of pull tabs such as tabs 78 and 79 are welded to opposed faces of honeycomb panel 75 proximate edge 76 to facilitate attachment of articulated arm 81 via a pull bar and gripping jaw structure 80. Similarly, a plurality of pull tabs such as pull tabs 83 and 84 are arranged in pairs and secured to opposite faces of honeycomb panel 75 adjacent edge 77 thereof. Pull tabs 83 and 84 are secured to an articulated arm 86 via a combination pull bar and gripping jaw 85.

In the configuration shown in FIG. 6, honeycomb panel 75 is positioned in contact with primary curve face 71 of primary form block 70 in preparation for commencing the initial step in the primary stage of panel formation.

With honeycomb panel 75 securely attached to gripping jaw assemblies 80 and 85, the stretch wrap machine supporting articulated arms 81 and 86 applies an outward force upon honeycomb panel 75 in the directions indicated by arrows 90 and 91 to impart a predetermined tension upon honeycomb panel 75.

FIG. 7 sets forth the top plan view of primary form block 70 and honeycomb panel 75 during the initial stretch wrapping of the honeycomb panel. Thus, as described above, primary form block 70 defines a primary curve face 71 and shoulders 72 and 73. As is also described above, honeycomb panel 75 defines edges 76 and 77. To avoid unduly cluttering of the drawing of FIG. 7, the pluralities of pull tabs as well as pull bar and gripping jaw assemblies 80 and 85 together with articulated arms 81 and 86 are omitted from FIG. 7. However, it will be understood in FIG. 7 as well as FIGS. 8 and 9 set forth and described below that such apparatus is secured to honeycomb panel 75 in the manner set above in FIG. 6.

In the configuration shown in FIG. 7, with tension continuing to be applied to honeycomb panel 75 in the directions indicated by arrows 90 and 91, the stretch wrap apparatus forces honeycomb panel 75 against primary form block 70 and wraps honeycomb panel 75 against primary curve surface 71 in the directions indicated by arrows 92 and 93. As honeycomb panel 75 is wrapped against primary curve surface 71 a primary curve portion 94 which conforms to surface 71 is formed in honeycomb panel 75.

FIG. 8 sets forth a top plan view of the stretch wrap apparatus having primary form block 70 operative upon honeycomb panel 75 during the initiation of the second stage of panel forming in accordance with the present invention. As described above in FIG. 7, primary form block 70 defines a primary curve face 71 and shoulders 73. As is also described above in FIG. 7, honeycomb panel 75 defines edges 76 and 77 which are drawn outwardly in the directions indicated by arrows 90 and 91 to impart a tension force to honeycomb panel 75. Honeycomb panels 75 has been wrapped against primary curve face 71 to form a primary curved portion 94 within honeycomb panel 75.

In the configuration shown in FIG. 8, the above described primary wrapping of honeycomb panel 75 against primary form block 70 as well as the outwardly directed tension imposed upon honeycomb panel 75 is maintained while a second stage form block 110 is positioned against honeycomb panel 75. In accordance with an important aspect of the present invention, second stage form block 110 defines a conforming curved surface 111 which corresponds to the curvature of curved portion 94 of honeycomb panel 75. In further accordance with an important aspect of the present invention, second stage form block 110 further defines reverse curve surfaces 112 and 113 on each side of conforming curved surface 111. The shape of reverse curve surfaces 112 and 113 as well as conforming curve surface ill is selected in accordance with the desired undulating curves to be formed within honeycomb panel 75. Thus, it will be apparent to those skilled in the art that in the event the present invention method is utilized in forming a different complex compound shape within honeycomb panel 75, the curvatures of primary form block 70 and second stage form block 110 would be correspondingly different from those shown in FIGS. 6 through 8. The important aspect with respect to the present invention is the conformity between conforming curve surface 111 of second stage form block 110 and primary curve face 71 of primary form block 70. This conformity allows the shape of primary curved portion 94 imposed upon honeycomb panel 75 to be maintained during subsequent shaping steps by continuing to hold second stage form block 110 against primary curved portion 94 of honeycomb panel 75. The combination of outwardly directed tension and the force of second stage form block 110 upon honeycomb panel 75 facilitates the further transformation of the shape of honeycomb panel 75 to form the undulating wave form panel (seen in FIG. 10) without damaging the structure of honeycomb panel 75.

FIG. 9 sets forth the top plan view of the stretch wrap operation shown in FIG. 8 with the final step of reverse wrap having taken place to complete the undulating wave form panel and thereby complete the final step of the primary stage portion of the present invention forming method. Thus, as set forth above, honeycomb panel 75 is formed against primary form block 70 which defines curved shoulders 72 and 73 and a primary curve portion 71 such that a primary curve portion 94 is formed against surface 71. Further, second stage form block 110 having reverse curved surfaces 112 and 113 and a conforming curve surface 111 is fitted against curve portion 94 and held against honeycomb panel 75 to captivate it between form blocks 70 and 110. In the preferred practice of the present invention method, the spacing between form blocks 70 and 110 is selected to captivate panel 75 without crushing or otherwise damaging it. Thereafter, as the outward tension the directions indicated by arrows 90 and 91 is maintained upon honeycomb panel 75, the stretch wrap machine reverse wraps the outer portions of honeycomb panel 75 in the directions indicated by arrows 114 and 115. This reverse wrap forms the outer portions of honeycomb panel 75 upon curved shoulder portions 112 and 113 of second stage form block 110.

At this point, the desired complex undulating wave form curve has been formed in honeycomb panel 75. Thereafter, the tension force upon honeycomb panel 75 is released and excess material is cut from honeycomb panel 75 at cut lines 95 and 96 to complete the undulating wave form panel shown in FIG. 10. It will be noted that the cutting along cut line 95 forms edge 105 while the cut along cut line 96 forms edge 106 of undulating wave form panel 100 (seen in FIG. 10). It will be further noted that the undulated wave form curves imposed upon honeycomb panel 75 in FIG. 9 provide a series of generally cylindrical component curves having generally parallel axes of curvature and producing an edge view which forms a single ribbon-like curvature.

FIG. 10 sets forth a perspective view of an undulating wave form panel 100 fabricated in accordance with the above described primary stage forming process together with a secondary stretch form block 120. Also shown in FIG. 10, is a variable displacement tensioning mechanism fabricated in accordance with the present invention and secured to undulating wave form panel 100. By way of overview, the operation to be performed in the apparatus of FIG. 10 comprises the secondary forming process of the present invention method in which the undulating wave form panel is tensioned in a transverse direction to that which was tensioned in the above described primary stage process. Further, the undulating wave form panel having been formed in the above described primary stage forming process is now wrapped in the transverse direction about the secondary stretch form block to impart the complex compound curve shape to the honeycomb panel. This entire fabrication has not heretofore been available and represents an important aspect of the present invention method of forming honeycomb panels into compound and complex curved shapes.

More specifically, undulating wave form panel 100 defines a complex curvature shown in FIG. 10 between edges 105 and 106. Panel 100 further defines opposed edges 102 and 103 to which the tensioning mechanism of the secondary stretch process is secured. In the preferred fabrication of the present invention, a pair of variable displacement tension bars 204 and 206 are positioned on each side of panel 100 and are supported by a pair of articulated power driven arms 125 and 126 shown in dash-line representation which in turn are supported by an otherwise conventional stretch wrap machine (not shown). The operation to be performed in the apparatus of FIG. 10 is that of an initially drawing variable displacement tension bars 204 and 206 outwardly in the directions indicated by arrows 205 and 207 to impart the desired tension to panel 100 and thereafter wrap panel 100 in the directions indicated by arrows 208 and 209 upon secondary stretch form block 120 to form the desired complex compound curves in panel 100. It will be noted that the resulting wrap and curvature imparted to panel 100 by this process is essentially transverse to the previously imparted curvatures.

More specifically, panel 100 having edges 102 and 103 is supported between variable displacement tension bars 204 and 206. Variable displacement tension bar 204 is secured to articulated arm 125 and further supports a plurality of inwardly extending articulating mechanisms 149 through 166. Articulating mechanisms 149 and 150 as well as tensioning mechanisms 160 through 162 are not visible due to the perspective view to FIG. 10 and the position of variable displacement tension bar 204. A corresponding plurality of pull tabs 129 through 146 are attached to panel 100 along edge 102 thereof by conventional attachment such as welding or the like and are further joined to articulating mechanisms 149 through 166. Articulating mechanisms 149 through 166 may for example comprise conventional hydraulic cylinder pulling units driven by conventional hydraulic power systems (not shown) with the essential function thereof being the ability of producing independent differential drawing forces against each of their respective pull tabs and variable displacement tension bar 204. In this manner, the degree of tension applied to different portions of panel 100 may be differentially controlled providing additional flexibility in the forming process.

Similarly, variable displacement tension bar 206 supports a corresponding plurality of articulating mechanisms 189 through 203 which are each secured to variable displacement bar 206 and are each further coupled to a corresponding plurality of pull tabs 169 through 183. Pull tabs 169 through 183 are attached to the edge portion of panel 100 by conventional fabrication techniques such as welding or the like. Once again the function of articulating mechanisms 189 through 203 may be provided by conventional hydraulic pulling apparatus driven by a conventional hydraulic power system (not shown). In the anticipated operation of the present invention differential variable displacement tensioning of panel 100, the tensioning applied by articulating mechanisms on each side of panel 100 is adjusted to provide tensioning of panel 100 which may vary from top to bottom of panel 100 but which is generally symmetrical along each edge of the panel. However, it may be desirable in some forming processes to use differential tensioning of panel 100 which is asymmetrical rather than symmetrical. The important advantage of the apparatus of FIG. 10 is the ability to impart independent differential tensions to selected areas of panel 100.

The secondary forming process of the present invention method is carried forward by initially positioning undulating wave form panel 100 against the front surface of form block 120 in the manner providing a contact line 101 at the general center of panel 100. The contact line arises from the identical curvature of undulating wave form panel 100 and the front portion of form block 120. Form block 120 is in accordance with the present invention curved in the direction transversed to the undulating curves of undulating wave form panel 100 in each direction from contact line 101. As an initial step, the stretch wrap mechanism of the host apparatus supporting variable displacement tension bars 204 and 206 (not shown) imparts a tension force outwardly upon panel 100 in the directions indicated by arrows 205 and 207. Additionally, articulating mechanisms 149 through 166 and 189 through 203 are independently adjusted to provide further differential tensioning of panel 100. Once the desired tension forces have been applied to undulating wave form panel 100 the tensioning is maintained and variable displacement tension bars 204 and 206 are moved rearwardly in the directions indicated by arrows 208 and 209 to wrap undulating wave form panel 100 against secondary stretch form block 120.

It will be apparent to those skilled in the art that the movement paths of variable displacement tension bars 204 and 206 is selected in accordance with the general shape of form block 120. Thus, for example, form blocks having a generally conical or frusto-conical shape require that tension bars 204 and 206 be pulled rearwardly and pivoted as the tension bars move rearwardly. In some instances, the tension bar movement may further include vertical movement in combination with the rearward pull and pivotal movement. The complexity of the tension bar wrapping movement is selected to avoid creating wrinkles or folds in the panel.

By way of further alternative, the secondary wrap shown in FIG. 10 may be accomplished using a heat-relaxing process such as that described and shown below in FIG. 15. In the event a more severely curved panel is fabricated, the present invention method may be used to form a pair of panels (or several panels) may be formed and joined along later weld seams such as weld seam 250 and 251 in FIG. 13.

Once the secondary wrap has been completed, the tension upon panel 100 may be released and the excess edge material on each side of panel 100 may be removed to produce the final shaped panel shown in FIG. 13.

It will be noted that in accordance with an important aspect of the present invention, the use of variable displacement tension bars and their respective independent articulating mechanisms allows discreet control of the individual pull tabs along the edges of the undulating wave form panel. In turn, this will control the movements of various portions of the panel during the stretch forming process. In particular, the relative side shift movements of the panel areas of smaller circumferential radii relative to the movement of panel areas of larger circumferential radii is provided.

FIG. 11*a* shows a simplified top plan view of the secondary stretch operation shown in FIG. 10. More specifically, undulating wave form panel 100 includes opposed edges 102 and 103 and an upper edge 106. A variable displacement tension bar 204 is supported by an articulated arm 125 and further supports a plurality of articulating mechanisms including mechanisms 149 through 155. A plurality of pull tabs including tabs 129 through 135 are attached to panel 100 near edge 102 and are respectively coupled to articulating mechanisms 149 through 155. A variable displacement tension bar 206 is supported by an articulated arm 126 and further supports a plurality of articulating mechanisms including mechanisms 189 through 195. Mechanisms 189 through 195 are joined to variable displacement tension bar 206 at one end and are further secured to a plurality of pull tabs 169 through 175. Pull tabs 169 through 175 are further attached to panel 100 by conventional attachment such as welding or the like. A secondary stretch form block 120 is supported by a spine 121 and is positioned in contact with panel 100. The contact of panel 100 and the front surface of secondary stretch form block 120 forms a contact line 101.

In operation, and as is described above, articulating arms 125 and 126 draw variable displacement tension bars 204 and 206 outwardly in the directions indicated by arrows 205 and 207 to place panel 100 in tension. Further, independent actuation of the articulating mechanisms on each side of undulating wave form panel 100 places selected portions of panel 100 in different tension. Thereafter, articulating arms 125 and 126 are moved rearwardly in the directions indicated by arrows 208 and 209 to wrap panel 100 upon secondary stretch form block 120 and complete the forming of panel 100. Once the secondary stretch wrap has been completed, panel 100 is removed from the work station and excess material is trimmed from the edges thereof to provide a completed shaped panel 185 shown in FIG. 13.

FIG. 11*b* sets forth a section view of panel 100 and secondary stretch form block 120 taken along section lines 11*b*—11*b* in FIG. 11*a*. Secondary stretch form block 120 is positioned in contact with undulating wave form panel 100 to form a contact line 101. Panel 100 further defines an upper edge 106 and a lower edge 105.

FIG. 12 sets forth a simplified top plan view of the apparatus of FIG. 11*a* having the pull tabs and stretch wrap and tension mechanisms omitted to facilitate a clearer illustration of panel 100 at the completion of the above described secondary stretch wrap process. Thus, secondary stretch form block 120 is shown having panel 100 having an upper edge 106 and side edges 102 and 103 wrapped upon secondary stretch form block 120 while in tension as indicated by arrows 205 and 207. The secondary wrap of panel 100 is achieved by wrapping the end portions of panel 100 inwardly and rearwardly as indicted by arrows 208 and 209.

FIG. 13 sets forth a perspective view of a completed and shaped honeycomb panel formed from panel 100 as indicated above and having excessive edge material removed therefrom to form a panel 185. FIG. 13 further shows a pair of additional panels formed identically to panel 185 and generally referenced by numerals 186 and 187 joined by weld seams 210, 211 and 212 to form a completed compound complex curve shaped object formed entirely of honeycomb panels. It will be apparent to those skilled in the art that a variety of different shapes may be formed in a similar manner to that described above to achieve differently shaped components fabricated of honeycomb panels. By way of further variation, panels 185, 186 and 187 may be formed in segments joined along weld seams 250 and 251. This further variation makes the forming of more radically curved panels.

Figure 14:
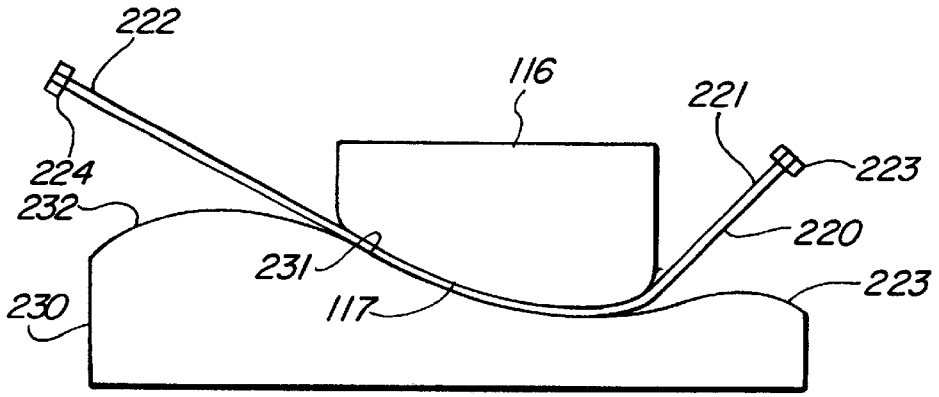
FIG. 14 sets forth a plan view of an alternate embodiment of the present invention which replaces the forming step shown in FIG. 8.
Figure 15:
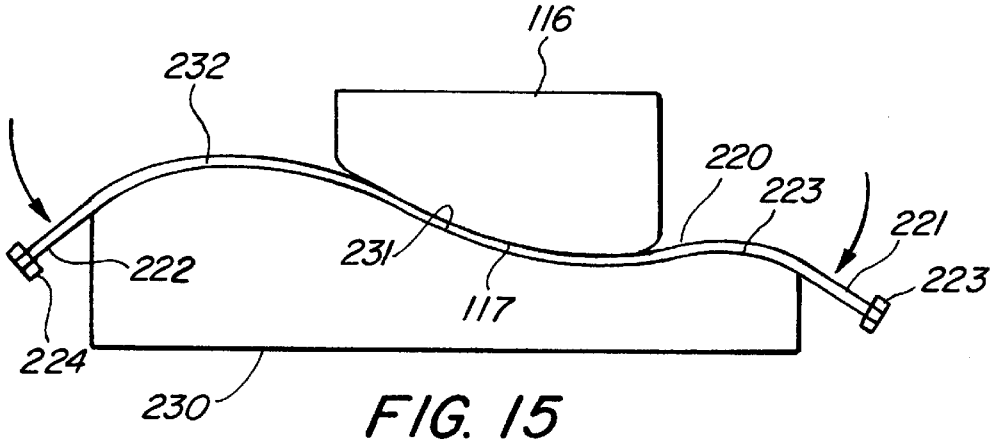
FIG. 15 sets forth a top plan view of the alternate embodiment of the present invention in the fabrication step shown in FIG. 9.

FIGS. 14 and 15 set forth alternative methods of carrying forward the reverse wrap steps shown in FIGS. 8 and 9 above. In essence, the alternative method of carrying forward both the initial and reverse wrap of a honeycomb panel is provided by heating the entire panel in a high temperature environment allowing the panel to soften and relax upon the curved surfaces of the second stage form blocks. This avoids the need to apply stress and tension to the honeycomb panel during the reverse wrap process. The resulting panel is then used in subsequent steps as illustrated in FIGS. 10 through 13 above in accordance with the present invention method.

In some instances, primary hot forming need be accomplished in two stages. FIG. 14 shows the panel configuration as a result of a previous hot forming first stage whereby form block 116 was placed in a furnace on its back and the flat panel placed to allow the panel to relax to the shape shown.

Now FIG. 14 goes on to illustrate the second stage hot forming by stacking form block 230, panel 220 and form block 116 as shown for introduction to the second stage furnace operation with the results shown in FIG. 15.

In some instances, the entire transformation may be accomplished in one heat sequence by stacking form blocks 116 and 230 with the flat panel 220 between and by utilizing restraints and guides not shown gain the results in FIG. 15.

More specifically, FIG. 14 shows a primary form block 116 having a primary curved surface 117 together with a honeycomb panel 220. In the configuration shown in FIG. 14, honeycomb panel 220 has been initially stretched wrapped upon or against form block 116 to assume the curvature shown in FIG. 14. In addition, FIG. 14 shows a second stage form block 230 having a conforming curve portion 231 which contacts panel 220 and captivates it against primary curved surface 117. Second stage form block 230 further includes shoulder curve portions 232 and 233. In contrast to the above described method, panel 220 is no longer in tension in FIG. 14 and instead end portions 221 and 222 of panel 220 receive predetermined weights 223 and 224. Thereafter, the assembly is subjected to a heat cycle at a sufficiently high temperature to cause panel 220 to soften and relax.

FIG. 15 shows the resulting configuration of panel 220 following the heat induced relaxation of the honeycomb panel. As described above, form block 116 having primary curved face 117 and second stage form block 230 are positioned to captivate a portion of honeycomb panel 220 following the above described stretch wrap primary process. Also described above, is the attachment of weights 223 and 224 to ends 221 and 222 respectively of honeycomb panel 220. Following the above mentioned heat cycle and relaxation of honeycomb panel 220 it can be seen that panel 220 has relaxed to form upon curved shoulders 232 and 233 of second stage form block 230. This relaxation has in essence allowed the end portions of honeycomb panel 220 to relax downwardly as indicated by arrows 235 and 236. Once the above described relaxation has taken place, the heat cycle may be completed and following sufficient cooling of honeycomb panel 220, the resulting undulating wave form panel formed in the heat cycle may be further processed as described above to provide a compound complex curved shaped honeycomb panel.

It will also be understood that the second stage forming of the undulating waveform panel into the complex shape may also be carried forward using the above described heat relaxation method step of panel forming. As described above, this heat relaxation forming step may also include the use of forms, weights and restraints.

What has been shown is a novel method of forming honeycomb panels such as metal honeycomb panels into compound complex curved shapes. The method described utilizes a primary stage of fabrication to form the honeycomb panel into an undulating wave form panel having a plurality of curved portions. The undulating wave form panel is then subjected to a transverse orientation stretch wrap process in a secondary stage of formation to impart a compound complex curved shape.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A method of forming a generally planar honeycomb panel into a compound curved shape comprising the steps of:

providing a generally planar honeycomb panel;

forming a primary curvature in said panel;

forming at least one reverse curvature in said panel, said reverse curvature being oppositely curved from said primary curvature, to form said panel into an undulating wave form panel; and forming a transverse curvature in said undulating wave form panel by producing a curvature in said undulating wave form panel transversely oriented with respect to said primary curvature and said at least one reverse curvature.

2. The method set forth in claim 1 wherein said step of forming a primary curvature includes the steps of:

providing a primary form block;

applying tension force to said panel; and stretch wrapping said panel against said primary form block.

3. The method set forth in claim 2 wherein said step of forming at least one reverse curvature includes the steps of:

providing a second stage form block having a conforming curvature portion conforming to said primary curvature in said panel and at least one reverse curvature;

positioning said second stage form block against said panel such that said conforming curvature is against said primary curvature in said panel; and reverse wrapping said panel against said second stage form block while maintaining said positioning step.

4. The method set forth in claim 3 wherein step of forming a transverse curvature includes the steps of:

providing a secondary stretch form block having an undulating curvature conforming to said undulating wave form panel and a transverse curvature oriented transversely from said undulating curvature;

positioning said undulating wave form panel against said secondary stretch form block;

applying tension force to said undulating wave form panel; and stretch wrapping said undulating wave form panel against said secondary stretch form block to form said undulating wave form panel to said transverse curvature.

5. The method set forth in claim 4 wherein said step of applying tension force to said undulating panel includes the steps of:

providing a plurality of actuating mechanisms operative upon opposed sides of said undulating wave form panel; and applying a plurality of localized tension forces to said undulating wave form panel during said step of stretch wrapping said undulating wave form panel against said secondary stretch form block.

6. The method set forth in claim 5 wherein said step of providing a plurality of actuating mechanisms operative upon opposed sides of said undulating wave form panel includes the steps of:

attaching a plurality of pull tabs to opposed sides of said undulating wave form panel; and attaching said plurality of actuating mechanisms to said plurality of pull tabs.

7. The method set forth in claim 2 wherein said step of forming at least one reverse curvature includes the steps of:

providing a second stage form block having a conforming curvature portion conforming to said primary curvature in said panel and at least one reverse curvature;

positioning said second stage form block against said panel such that said conforming curvature is against said primary curvature in said panel; and heating said panel to a temperature sufficient to relax said panel upon said second stage form block.

8. The method set forth in claim 7 wherein said steps of heating said panel includes the step of attaching weights to said panel.

9. The method set forth in claim 8 wherein step of forming a transverse curvature includes the steps of:

providing a secondary stretch form block having an undulating curvature conforming to said undulating wave form panel and a transverse curvature oriented transversely from said undulating curvature;

positioning said undulating wave form panel against said secondary stretch form block;

applying tension force to said undulating wave form panel; and stretch wrapping said undulating wave form panel against said secondary stretch form block to form said undulating wave form panel to said transverse curvature.

10. The method set forth in claim 9 wherein said step of applying tension force to said undulating panel includes the steps of:

providing a plurality of actuating mechanisms operative upon opposed sides of said undulating wave form panel; and applying a plurality of localized tension forces to said undulating wave form panel during said step of stretch wrapping said undulating wave form panel against said secondary stretch form block.

11. The method set forth in claim 10 wherein said step of providing a plurality of actuating mechanisms operative upon opposed sides of said undulating wave form panel includes the steps of:

attaching a plurality of pull tabs to opposed sides of said undulating wave form panel; and attaching said plurality of actuating mechanisms to said plurality of pull tabs.

12. The method set forth in claim 1 wherein said step of forming at least one reverse curvature includes the steps of:

providing a second stage form block having a conforming curvature portion conforming to said primary curvature in said panel and at least one reverse curvature;

positioning said second stage form block against said panel such that said conforming curvature is against said primary curvature in said panel; and reverse wrapping said panel against said second stage form block while maintaining said positioning step.

13. The method set forth in claim 12 wherein said step of forming a primary curvature includes the steps of:

providing a primary form block;

applying tension force to said panel; and stretch wrapping said panel against said primary form block.

14. The method set forth in claim 1 wherein step of forming a transverse curvature includes the steps of:

providing a secondary stretch form block having an undulating curvature conforming to said undulating wave form panel and a transverse curvature oriented transversely from said undulating curvature;

positioning said undulating wave form panel against said secondary stretch form block;

applying tension force to said undulating wave form panel; and stretch wrapping said undulating wave form panel against said secondary stretch form block to form said undulating wave form panel to said transverse curvature.

15. A method of forming a generally planar panel into a compound curved shape comprising the steps of:

providing stretch wrap apparatus having form block supports and articulated arms;

providing a primary form block having a primary curve face and supporting said primary form block upon said stretch wrap apparatus;

providing a generally planar honeycomb panel;

positioning said honeycomb panel against said primary form block;

coupling said articulated arms to opposed sides of said panel;

applying tension to said panel;

wrapping said panel against said primary form block;

providing a second stage form block defining a conforming curvature conforming to said primary curve face and at least one reverse curvature;

positioning said second stage form block against said panel;

while maintaining said panel in tension, reverse wrapping said panel against said at least one reverse curvature to form an undulating wave form panel;

providing a secondary stretch form block having an undulating curved surface conforming to said undulating wave form panel and transverse curved surface;

positioning said undulating wave form panel against said secondary stretch form block;

coupling said articulated arms to opposed sides of said undulating wave form panel;

applying tension to said undulating wave form panel; and while maintaining said tension, wrapping said undulating wave form panel against said secondary stretch form block to impart a transverse curvature to said undulating wave form panel corresponding to said transverse curved surface.

16. The method set forth in claim 1 wherein said step of forming a primary curvature includes the steps of:

providing a primary form block;

placing said honeycomb panel upon said primary form block; and heating said honeycomb panel to relax it upon said primary form block.

17. The method set forth in claim 16 wherein said step of forming at least one reverse curvature includes the steps of:

providing a second stage form block having a conforming curvature portion conforming to said primary curvature in said panel and at least one reverse curvature;

positioning said honeycomb panel upon said second stage form block such that said conforming curvature is against said primary curvature in said panel; and reverse curving said honeycomb panel against said second stage form block by heating and relaxing while maintaining said positioning step.

* * * * *